US010465265B2

(12) United States Patent
Kim et al.

(10) Patent No.: US 10,465,265 B2
(45) **Date of Patent: *Nov. 5, 2019**

(54) PERFORATION RESISTANCE IMPROVED ALUMINUM ALLOY FOR HEAT EXCHANGER, PERFORATION RESISTANCE IMPROVED ALUMINUM EXTRUSION TUBE AND FIN MATERIAL COMPRISING ALUMINUM ALLOY, AND HEAT EXCHANGER FORMED OF EXTRUSION TUBE AND FIN MATERIAL

(71) Applicant: RESEARCH & BUSINESS FOUNDATION SUNGKYUNKWAN UNIVERSITY, Suwon-si (KR)

(72) Inventors: Jung Gu Kim, Seongnam-si (KR); In Jun Park, Anyang-si (KR)

(73) Assignee: Research & Busines Foundation Sungkyunkwan University, Suwon-si (KR)

( * ) Notice: Subject to any disclaimer, the term of this patent is extended or adjusted under 35 U.S.C. 154(b) by 76 days.

This patent is subject to a terminal disclaimer.

(21) Appl. No.: 15/025,067

(22) PCT Filed: Sep. 26, 2014

(86) PCT No.: PCT/KR2014/009003

§ 371 (c)(1),
(2) Date: Mar. 25, 2016

(87) PCT Pub. No.: WO2015/046942

PCT Pub. Date: Apr. 2, 2015

(65) Prior Publication Data

US 2016/0237528 A1 Aug. 18, 2016

(30) Foreign Application Priority Data

Sep. 27, 2013 (KR) ..... 10-2013-0115043
Sep. 24, 2014 (KR) ..... 10-2014-0127446

(51) Int. Cl.
*C22C 21/02* (2006.01)
*F28F 21/08* (2006.01)
(Continued)

(52) U.S. Cl.
CPC ..... *C22C 21/02* (2013.01); *C22C 21/00* (2013.01); *F28F 1/40* (2013.01); *F28F 19/00* (2013.01); *F28F 21/084* (2013.01)

(58) Field of Classification Search
CPC ..... C22C 21/00; C22C 21/02; C22C 21/04; C22C 21/12; C22C 21/14; F28F 19/00; F28F 1/40; F28F 21/084
See application file for complete search history.

(56) References Cited

U.S. PATENT DOCUMENTS 4,503,907 A * 3/1985 Tanaka ..... B05D 7/14 165/133

FOREIGN PATENT DOCUMENTS

CN 1264431 A 8/2000
JP 5-263172 A 10/1993
(Continued)

OTHER PUBLICATIONS

International Search Report dated Dec. 18, 2014 in counterpart International Application No. PCT/KR2014/009003 (4 pages, with English translation).

*Primary Examiner* — Colleen P Dunn
*Assistant Examiner* — Anthony M Liang
(74) *Attorney, Agent, or Firm* — NSIP Law

(57) ABSTRACT

The present disclosure provides an aluminum alloy with enhanced penetration resistance for a heat exchanger, the alloy containing copper (Cu), silicon (Si), and iron (Fe) equal to or smaller than predetermined contents respectively, and further containing zirconium (Zr) and the remainder being aluminum (Al). Further, the present disclosure pro-
(Continued)

vides an aluminum extruded tube and/or an aluminum fin with enhanced penetration resistance made of the alloy respectively. Further, the present disclosure provides a heat exchanger comprising the tube and/or fin. Addition and content-control of the alloy element may spread corrosion initiations and suppress intergranular corrosion to create uniform corrosion. In this manner, the present alloy have superior corrosion resistance compared to pitting corrosion of a previous alloy for a heat exchanger, and, at the same time, have an extrusion rate equal to that of the previous A1070.

8 Claims, 8 Drawing Sheets

(51) Int. Cl.

| | |
|---|---|
| ***C22C 21/00*** | (2006.01) |
| ***F28F 19/00*** | (2006.01) |
| ***F28F 1/40*** | (2006.01) |

(56) References Cited

FOREIGN PATENT DOCUMENTS

| | | | | | |
|---|---|---|---|---|---|
| JP | 11-21649 | A | | 1/1999 | |
| JP | 2003-119534 | A | | 4/2003 | |
| JP | 2005126799 | A | * | 5/2005 | |
| JP | 2008-208416 | A | | 9/2008 | |
| JP | 2009-127122 | A | | 6/2009 | |
| JP | 2013122083 | A | * | 6/2013 | ..... C22C 21/00 |

* cited by examiner

PERFORATION RESISTANCE IMPROVED ALUMINUM ALLOY FOR HEAT EXCHANGER, PERFORATION RESISTANCE IMPROVED ALUMINUM EXTRUSION TUBE AND FIN MATERIAL COMPRISING ALUMINUM ALLOY, AND HEAT EXCHANGER FORMED OF EXTRUSION TUBE AND FIN MATERIAL

CROSS-REFERENCE TO RELATED APPLICATION

The present application claims a priority to a Korean patent application number 2014-0127446 filed on Sep. 24, 2014, which claims a priority to a Korean patent application number 2013-0115043 filed on Sep. 27, 2013, the entire disclosures of which are incorporated herein in its entirety by reference.

BACKGROUND

Technical Field

The present disclosure generally relates to an aluminum alloy with enhanced penetration resistance for a heat exchanger, an aluminum tube and a fin for a heat exchanger, made of the alloy, and a heat exchanger comprising the tube and fin. More particularly, the present disclosure relates to an aluminum tube and an aluminum fin for a heat exchanger, and a heat exchanger comprising the tube and fin, where the tube and fin have enhanced penetration and corrosion resistances to prevent the tube and fin from penetration and damage, which otherwise occur due to corrosion caused by internal refrigerant and external condensed water in the heat exchanger, for example, in an air-conditioner, refrigerator, radiator, etc.

Discussion of Related Arts

Recently, a material for a heat exchanger has changed from copper to aluminum in terms of costs, workability, corrosion resistance, etc. This is because that aluminum is weight-light, inexpensive, and highly thermal conductive.

Aluminum-based materials for a heat exchanger includes pure aluminum-based formulations (A1XXX) with a high extrusion rate, high thermal conductance, and a low cost, and aluminum manganese-based formulations (A3XXX) with a lower extrusion rate compared to the pure aluminum-based formulations, a relatively high strength, and relatively high corrosion resistance.

A following Table 1 describes respective compositions of A1070 and A3003 alloys as the previous aluminum-based formulations for a heat exchanger. The A1070 belongs to the pure aluminum-based formulations, while the A3003 belongs to the aluminum manganese-based formulations.

TABLE 1

| name | Cu | Si | Fe | Zn | Mg | Mn | Ti | Al. |
|---|---|---|---|---|---|---|---|---|
| A1070 | 0.03 | 0.20 | 0.25 | 0.04 | 0.03 | 0.03 | 0.03 | Remainder |
| A3003 | 0.158 | 0.084 | 0.421 | 0.034 | 0.001 | 1.021 | 0.014 | Remainder |

The A1070 may be employed for a tube and a fin, for example, in a condenser in home appliances such as an air-conditioner, a refrigerator, etc. where a high strength of the Al based material is not demanded but economical aspects such as a low material cost, and a low extrusion cost of the Al based material are demanded. To the contrary, the A3003 has a higher strength and corrosion resistance, but more expensive extrusion cost compared to the A1070, and, thus may be employed for a tube and a fin of a heat exchanger in an intercooler, radiator, etc. in an automobile.

Aluminum may have a high chemical activation, and may form an oxidized film at a surface thereof in an air space to have high corrosion resistance. However, when aluminum undergoes corrosion, there may occur a pitting corrosion where corrosion may occur only at a local area in which the oxidized film is damaged. Further, the corrosion may propagate and concentrate on a certain area due to electrochemical reaction with various impurities in the aluminum alloy. This corrosion mechanism may cause an aluminum heat exchanger to be locally penetrated, leading to a leak of internal refrigerant or hot fluids. Therefore, there is a need for an aluminum alloy with enhanced penetration resistance for the heat exchanger.

Further, the home appliances have been widely used in China, India etc. suffering from heavy air pollution. In these countries, the aluminum heat exchanger in the home appliances may be susceptible to such a leak therefrom due to the corrosion. This may be true of a seashore area. This leak may cause economical loss such as a component replacement, and may lead to deterioration of the home appliances.

FIG. 1 shows a mechanism for pitting corrosion and intergranular corrosion of a previous aluminum formulation. A left side drawing in FIG. 1 shows a grain-boundary distribution of a cathodic site. To be specific, a protective passive film is formed on an aluminum surface, and $Al_2Cu$, $Al_3Fe$, etc. are distributed along and in the grain boundary. Upon a start of corrosion, pitting corrosion is initiated, such that, as shown in a middle drawing in FIG. 1, there may be generated a potential difference between a base material and the intermetallic phase materials $Al_2Cu$, and $Al_3Fe$, and, thus, a local circuit may be created. This may lead to the passive film damage, which may confirm the pitting corrosion initiation. Then, as shown in a right side drawing in FIG. 1, the pitting corrosion propagates. In this connection, a propagation rate of the pitting corrosion along the grain boundary may be higher than an initiation rate of new pitting corrosion at the surface of the alloy. This causes a larger penetration depth relative to an actual corrosion amount. This aluminum corrosion mechanism may cause a local penetration through the aluminum heat exchanger, and, thus, a leak of an internal refrigerant or hot fluid from the exchanger.

FIG. 2 illustrates corrosion propagation behavior in a previous aluminum alloy for a heat exchanger. As shown in the figure, a penetration depth becomes gradually larger due to the propagation of the pitting corrosion as time goes by.

Prior-art patent documents are follows: Japanese Patent Laid-Open No. 2005-126799 A; Japanese Patent Laid-Open No. 2013-122083 A; and Japanese Patent Laid-Open No. 2010-053410 A.

SUMMARY

The present disclosure may provide an aluminum alloy for a tube and a fin in a heat exchanger, the alloy having enhanced penetration resistance and corrosion resistance and, at time same time, a non-lowered extrusion rate, which are not the case in the previous A1070 and A3003 aluminum alloys. This may be achieved by adding zirconium (Zr) into the alloy and adjusting a composition thereof to suppress corrosion concentration and thus allow uniform corrosion.

Further, the present disclosure may provide an aluminum extruded tube and an aluminum fin for a heat exchanger, the tube and fin being made of the above-defined aluminum alloy, and, thus, having enhanced penetration resistance. Further, the present disclosure may provide a heat exchanger comprising the above-defined tube and fin.

In one aspect of the present disclosure, there is provided an aluminum alloy with enhanced penetration resistance for a heat exchanger, the alloy containing in % by weight: 0.05%≤zirconium (Zr)≤0.17%; 0%<copper (Cu)≤0.01%; 0%<silicon (Si)≤0.2%; 0%<iron (Fe)≤0.2%; and the remainder being aluminum (Al), and unavoidable impurities.

In one aspect of the present disclosure, there is provided an aluminum tube with enhanced corrosion resistance for a heat exchanger, the tube being made of the above-defined aluminum alloy.

In one aspect of the present disclosure, there is provided an aluminum fin with enhanced corrosion resistance for a heat exchanger, the fin being made of the above-defined aluminum alloy.

In one aspect of the present disclosure, there is provided a heat exchanger with enhanced corrosion resistance, the exchanger comprising the above-defined aluminum tube.

In one aspect of the present disclosure, there is provided a heat exchanger with enhanced corrosion resistance, the exchanger comprising the above-defined aluminum fin.

In one aspect of the present disclosure, there is provided a heat exchanger with enhanced corrosion resistance, the exchanger comprising an aluminum fin and an aluminum tube, wherein both the fin and tube are defined above.

In accordance with the present disclosure, the above-defined aluminum alloy may have superior penetration resistance and corrosion resistance, compared to the previous A1070 for a heat exchanger, and, thus, have superior corrosion and penetration resistances against external condensed water and internal refrigerant. To be specific, the addition of the zirconium (Zr) may allow uniform corrosion of the alloy, and, thus, more enhanced penetration resistance relative to the pitting corrosion.

Furthermore, in accordance with the present disclosure, controlled concentration of copper (Cu) may suppress intergranular corrosion, and, thus, may spread corrosion propagation, leading to enhanced penetration resistance of the alloy.

Furthermore, in accordance with the present disclosure, the above-defined aluminum alloy may exhibit an extrusion rate (about 90 m/min) similar to that of the previous A1070, and, thus, have good productivity and economy.

Furthermore, in accordance with the present disclosure, the above-defined heat exchanger may include components (for example, the fin and tube) thereof with enhanced corrosion resistance, such that the exchanger has a prolonged lift span, good performance, and more energy-saving effect due to lack of leak of the refrigerant and, thus, improved heat-exchanging efficiency.

BRIEF DESCRIPTION OF THE DRAWINGS

A brief description of each drawing is provided to more fully understand the drawings, which is incorporated in the detailed description of the disclosure.

DETAILED DESCRIPTIONS

Figure 1:
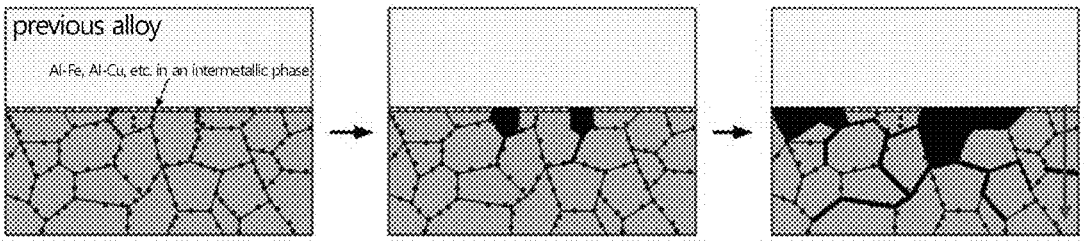
FIG. 1 shows a mechanism for pitting corrosion and intergranular corrosion of a previous aluminum alloy.
Figure 2:
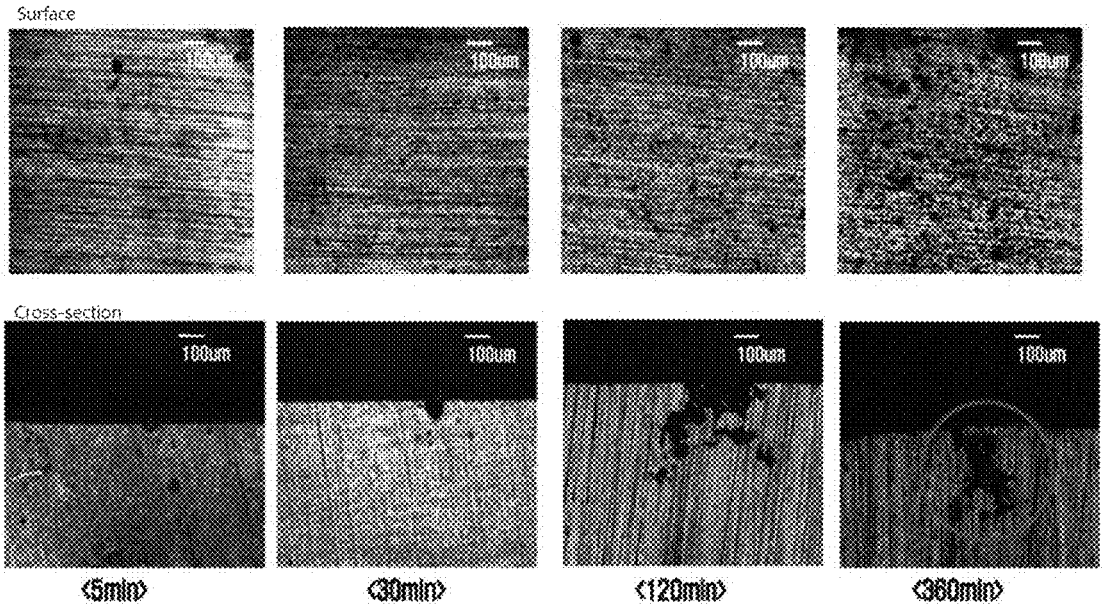
FIG. 2 illustrates corrosion propagation behavior in a previous aluminum alloy for a heat exchanger.

Examples of various embodiments are illustrated in the accompanying drawings and described further below. It will be understood that the discussion herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated elements, and/or components, but do not preclude the presence or addition of one or more other elements, components, and/or portions thereof. As used herein, the term "and/or" includes any and all combinations of one or more of the associated listed items.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the practice of the present disclosure. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.3, or 5.5 to 10, or 2.7 to 6.1.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present disclosure refers to "one or more embodiments of the present disclosure."

In one embodiment of the present disclosure, an aluminum alloy with enhanced penetration resistance for a heat exchanger includes zirconium (Zr), copper (Cu), silicon (Si), iron (Fe), the remainder being aluminum (Al), and unavoidable impurities.

The zirconium (Zr), copper (Cu), silicon (Si), and iron (Fe) each may be controlled in a content thereof to be smaller than or equal to predetermined concentrations.

The zirconium (Zr) may be controlled in a content thereof to be 0.05% by weight to 0.17% by weight. The copper (Cu) may be controlled in a content thereof to be equal to or smaller than 0.01% by weight. The silicon (Si) may be controlled in a content thereof to be equal to or smaller than 0.2% by weight. The iron (Fe) may be controlled in a content thereof to be equal to or smaller than 0.2% by weight.

Hereinafter, a reason for content control of each component, and a property thereof will be first described, which, in turn, will be supported by a numerical-limitation example using experiment data for a numerical content of each component.

In one embodiment of the present disclosure, the aluminum alloy with enhanced penetration resistance for a heat exchanger contains zirconium (Zr). The zirconium may not only refine a grain size to improve strength of the alloy, but also suppress pitting corrosion and, thus, allow uniform corrosion. The suppression of pitting corrosion, and, thus, creation of the uniform corrosion may be achieved as follows: the addition of zirconium may generate a potential difference in the alloy to finely spread precipitations serving as initiation points for corrosion, and thus, may suppress the pitting corrosion occurring locally and intensely and thus hard to predict corrosion locations. To achieve the uniform corrosion, the zirconium may be added into the alloy by a content equal to or greater than about 0.05% by weight. Further, in order to suppress a crack in the alloy and improve an extrusion rate, the zirconium may be added into the alloy by a content equal to or smaller than about 0.17% by weight.

Figure 5:
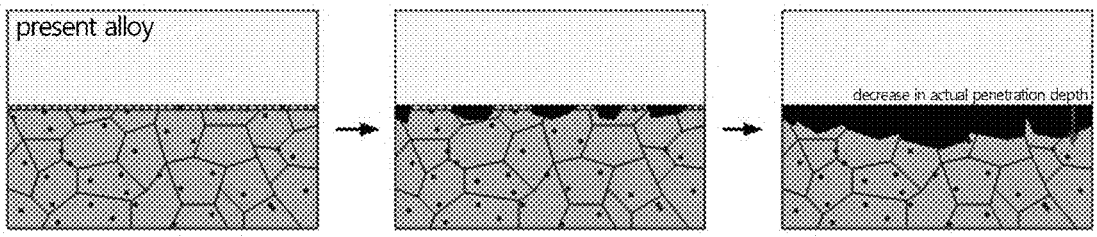
FIG. 5 is a schematic view illustrating a pitting corrosion and intergranular corrosion mechanism of an aluminum alloy of the present disclosure.

FIG. 5 is a schematic view illustrating a pitting corrosion and intergranular corrosion mechanism of the present aluminum alloy. As shown in FIG. 5, in the aluminum alloy in accordance with the present disclosure, the addition of the zirconium (Zr) may allow a decrease of a precipitation of $Al_2Cu$, $Al_3Fe$, etc. in the grain boundary in the intermetallic phase, and, thus, spread the precipitation of $Al_2Cu$, $Al_3Fe$, etc. For a comparison, in FIG. 1, the $Al_2Cu$, $Al_3Fe$, etc. mainly reside at the grain boundary, while in FIG. 5 (see a left side drawing therein), the precipitation of the $Al_2Cu$, $Al_3Fe$, etc. in the grain boundary may decrease.

Further, as shown in a middle drawing of FIG. 5, it is confirmed that upon start of pitting corrosion, corrosion initiation points are disperse. For a comparison, in FIG. 1, upon start of pitting corrosion, the corrosion occurs in a local and concentrated manner.

Finally, as shown in a right drawing of FIG. 5, it is confirmed that upon propagation of the pitting corrosion, the corrosion may not concentrate on a certain location, and, thus, may be suppressed in a deep and inwardly direction. As a result, upon the pitting corrosion propagation, inwardly penetration may be less probable. To the contrary, in FIG. 1 (see a right side drawing therein), the pitting corrosion may propagate along the grain boundary, and, thus, the inwardly penetration depth may be larger than that in the aluminum alloy of the present disclosure.

In order to examine zirconium contents in terms of a critical meaning, corrosion experiments under conditions of a following Table 2 were conducted. As indicated from the Table 2, contents of zirconium changes, while contents of remaining components, namely, copper, silicon, and iron are set to substantially constant level. Further, the Table 2 also indicates experimental results, that are, corrosion depth averages and corresponding corrosion depth standard deviations.

TABLE 2

| | Cu (fixed) | Si (fixed) | Fe (fixed) | Zr (variable) | corrosion depth average (μm) | corrosion depth standard deviation |
|---|---|---|---|---|---|---|
| 1 | 0.010 | 0.201 | 0.207 | 0 | 51.21 | 12.24 |
| 2 | 0.011 | 0.197 | 0.205 | 0.031 | 47.89 | 7.21 |
| 3 | 0.012 | 0.198 | 0.202 | 0.052 | 27.54 | 6.34 |
| 4 | 0.012 | 0.202 | 0.204 | 0.103 | 22.24 | 5.71 |
| 5 | 0.009 | 0.204 | 0.197 | 0.151 | 21.19 | 5.64 |
| 6 | 0.009 | 0.209 | 0.197 | 0.169 | 25.71 | 6.87 |
| 7 | 0.013 | 0.199 | 0.202 | 0.213 | 38.27 | 10.27 |

In the above Table 2, a content of each component refers to a content in % by weight. In order to determine an optimal zirconium content, the experiment conditions are set such that only contents of zirconium are variable, while contents of remaining components, namely, copper, silicon, and iron are fixed. The determination of the optimal zirconium content may be derived from a resulting corrosion depth average and corresponding corrosion depth standard deviation.

As seen from the above Table 2, the corrosion depth averages relative to varying contents of the zirconium shows critical points. In order words, at the critical points, the corrosion depth averages show sharp changes. To be specific, a point of the zirconium content being 0.05% by weight may be one critical point. When the zirconium content just exceeds 0.05% by weight, the corrosion depth average value sharply decreases. Further, a point of the zirconium content being 0.17% by weight may be another critical point. When the zirconium content just exceeds 0.17% by weight, the corrosion depth average value sharply increases.

Figure 6:
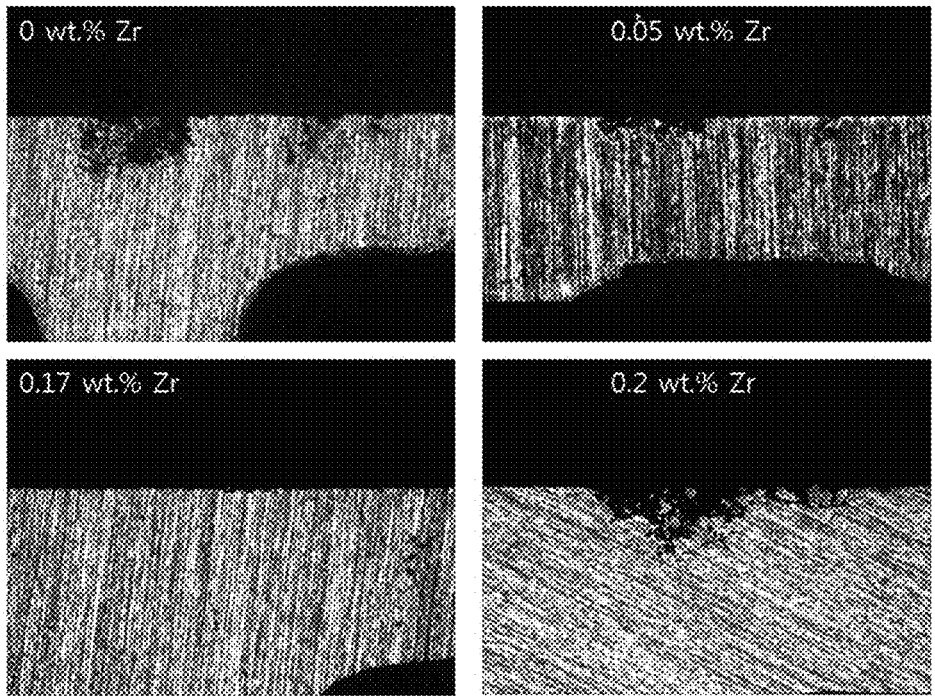
FIG. 6 illustrates pictures describing varying corrosion depths of an aluminum alloy of one embodiment of the present disclosure, relative to varying zirconium contents.
Figure 7:
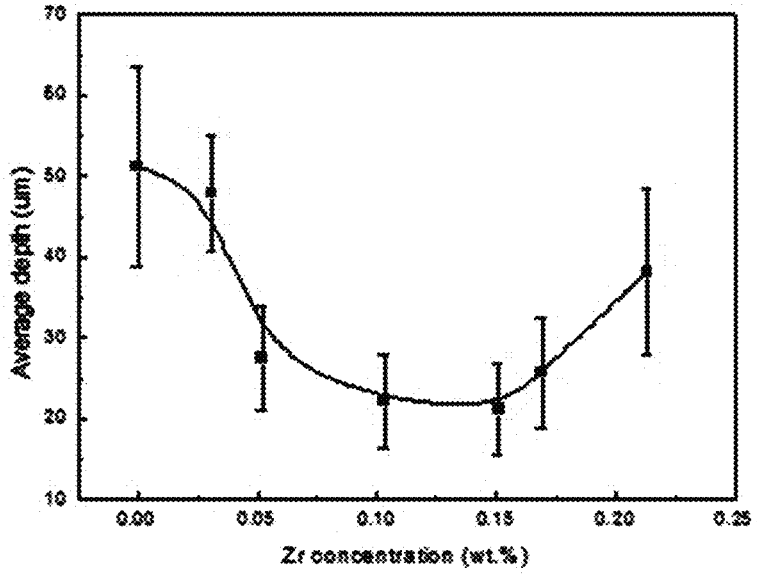
FIG. 7 illustrates a graph describing varying corrosion penetration depths of an aluminum alloy of one embodiment of the present disclosure, relative to varying zirconium contents.

As shown from FIG. 7, it is confirmed that the average corrosion depths relative to the zirconium contents indicate lower values only for a certain range of the zirconium content (i.e. a range from 0.05% by weights to 0.17% by weight), while the average corrosion depths relative to the zirconium contents indicate higher values for ranges other than the certain range. The corrosion average depth exceeding 40 μm may fall into a substantial penetration-occurring depth. Further, as shown in FIG. 6, it is observed that substantially low and equal corrosion penetration depths (about 20 μm) result from the zirconium contents of 0.05% by weight and 0.17% by weight, while the corrosion penetration depths increase greatly for the zirconium content smaller than 0.05% by weight and the zirconium content larger than 0.17% by weight (the corrosion penetration depths being equal to or larger than about 40 μm).

Therefore, the zirconium content may act as a key factor for suppressing the penetration. In accordance with the present disclosure, the zirconium (Zr) content may be controlled to be 0.05% by weight to 0.17% by weight.

In order to identify controls of contents for each component in the alloy of the present disclosure, an experiment to measure corrosion penetration depths is conducted in the following procedure:

First, in an alloy casting process, a master alloy is dissolved at about 730° C., and is agitated and, then, is injected into a plate-shaped mold preheated at 150° C., resulting in a cast plate-shaped alloy. Then, a releasing agent such as a boron nitride is applied to the cast alloy. Next, corrosion acceleration is conducted. For this acceleration, the cast alloy is cut into tests pieces. The alloy test piece is controlled to have an exposure area of 1 $cm^2$. The test piece is immersed for 4 hours in a test solution (synthetic acid rain) of pH 5 containing 4 ppm $SO4^{2-}$, 2.5 ppm $NO^{2-}$, and 1.7 ppm $Cl^-$, and, then, has a constant potential of 0.25 V applied thereto for 6 hours, the potential being relative to SCE (saturated calomel electrode). Upon completion of the corrosion acceleration procedure, the test piece is mounted on a cutting device and then the corrosion accelerated portion is cut and divided in a 0.25 cm spacing to obtain four corrosion accelerated cross-section portions. The cross-section portions are measured regarding corrosion types and corrosion penetration depths using an optical microscope.

Regarding an alloy formation, when a metal has a different element injected intentionally thereto, the element is referred to as an alloy element. Meanwhile, impurities are unavoidably injected into the alloy due to a technical limitation and an economical aspect during the alloy formation. The impurities may be limited in contents thereof by contents equal to or smaller than acceptable amounts, and, thus, presences thereof in the alloy may be acceptable. The acceptable contents of the impurities may depend on what extent of harmful impurities give the metal.

In this connection, elements copper (Cu), silicon (Si) and iron (Fe) contained in the present aluminum alloy with enhanced penetration resistance for a heat exchanger fall into the impurities unavoidably contained in the aluminum alloy. These impurities may generate precipitations susceptible to corrosion, and, promote cathodic reaction in the corrosion environment. Thus, the impurities should be controlled in contents thereof in the alloy.

Specifically, the copper (Cu) may react with the aluminum and hence be precipitated as $Al_2Cu$ promoting the cathodic reaction of corrosion. The copper may mainly reside in a continuous or networking manner along the grain boundary of the aluminum, and, thus, may be a factor for intergranular corrosion where the corrosion damage propagates along the grain boundary. This intergranular corrosion may cause the aluminum alloy for a heat exchanger to be susceptible to the penetration. In order to avoid the intergranular corrosion, the copper should be controlled in a content thereof by a content smaller than a high content at a room temperature. In the present disclosure, the copper (Cu) content may be controlled by a content larger than 0% by weight and equal to or smaller than about 0.01% by weight.

In order to examine copper contents in terms of a critical meaning, corrosion experiments under conditions of a following Table 3 were conducted. As indicated from the Table 3, contents of copper changes, while contents of remaining components, namely, zirconium, silicon, and iron are set to substantially constant level. Further, the Table 3 also indicates experimental results, that is, corrosion depth averages and corresponding corrosion depth standard deviations.

TABLE 3

| | Cu (variable) | Si (fixed) | Fe (fixed) | Zr (fixed) | corrosion depth average (μm) | Corrosion depth standard deviation |
|---|---|---|---|---|---|---|
| 1 | 0.001 | 0.201 | 0.199 | 0.154 | 20.42 | 5.11 |
| 2 | 0.005 | 0.198 | 0.203 | 0.150 | 20.37 | 4.90 |
| 3 | 0.011 | 0.197 | 0.205 | 0.151 | 21.19 | 5.64 |
| 4 | 0.021 | 0.199 | 0.202 | 0.149 | 32.14 | 8.51 |
| 5 | 0.030 | 0.202 | 0.201 | 0.148 | 41.24 | 12.62 |

Figure 8:
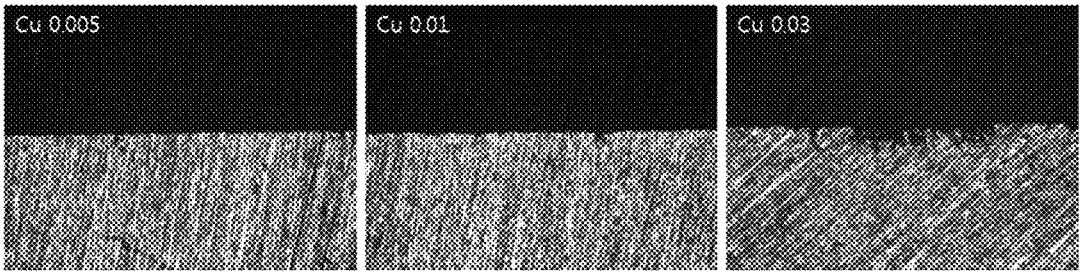
FIG. 8 illustrates pictures describing varying corrosion depths of an aluminum alloy of one embodiment of the present disclosure, relative to varying copper contents.
Figure 9:
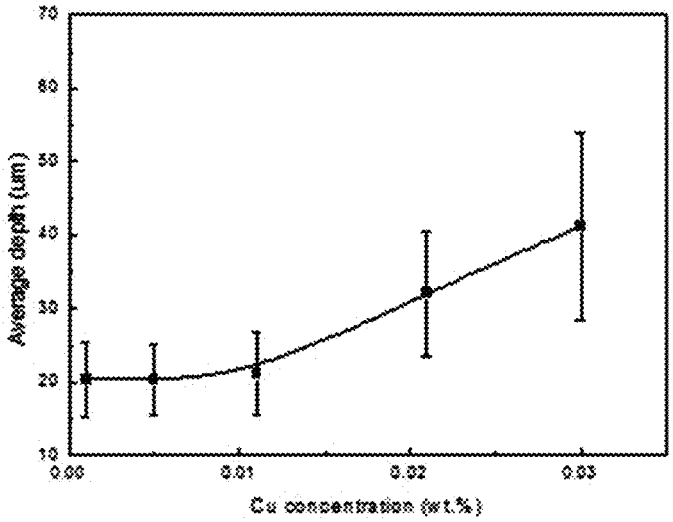
FIG. 9 illustrates a graph describing varying corrosion penetration depths of an aluminum alloy of one embodiment of the present disclosure, relative to varying copper contents.

As seen from the above Table 3, when the copper content is equal to or smaller than about 0.01% by weight, uniform corrosion may occur. However, when the copper content is greater than about 0.01% by weight, the uniform corrosion may not occur. Further, when the copper content is greater than about 0.03% by weight, the corrosion penetration depth greatly increases. Specific results are illustrated in FIG. 8 and FIG. 9. As shown in FIG. 8, when the copper content is 0.005% by weight and 0.01% by weight, corrosion penetration depths are substantially equal and low (about 20 μm). As shown in FIG. 8, when the copper content is 0.03% by weight, the corrosion penetration depth increases greatly (about 40 μm).

Therefore, the copper content may act as a key factor for suppressing the penetration. In accordance with the present disclosure, the copper (Cu) content may be controlled to be greater than 0% by weight and be equal to or smaller than about 0.01% by weight.

The silicon (Si) may react with unavoidable impurities (magnesium) to generate precipitations, which may promote cathodic reaction in corrosion environment. Thus, the silicon content should be minimized. In the present disclosure, the silicon (Si) content may be controlled to be greater than 0% by weight and equal to or smaller than about 0.2% by weight.

In order to examine silicon contents in terms of a critical meaning, corrosion experiments under conditions of a following Table 4 were conducted. As indicated from the Table 4, contents of silicon changes, while contents of remaining components, namely, zirconium, copper, and iron are set to substantially constant level. Further, the Table 4 also indicates experimental results, that is, corrosion depth averages and corresponding corrosion depth standard deviations.

TABLE 4

| | Cu (fixed) | Si (variable) | Fe (fixed) | Zr (fixed) | corrosion depth average (μm) | corrosion depth standard deviation |
|---|---|---|---|---|---|---|
| 1 | 0.011 | 0.015 | 0.201 | 0.154 | 19.98 | 5.01 |
| 2 | 0.009 | 0.049 | 0.199 | 0.152 | 21.53 | 7.27 |
| 3 | 0.010 | 0.102 | 0.202 | 0.148 | 21.29 | 6.24 |
| 4 | 0.011 | 0.197 | 0.205 | 0.151 | 21.19 | 5.64 |
| 5 | 0.011 | 0.298 | 0.210 | 0.149 | 43.43 | 16.69 |

Figure 10:
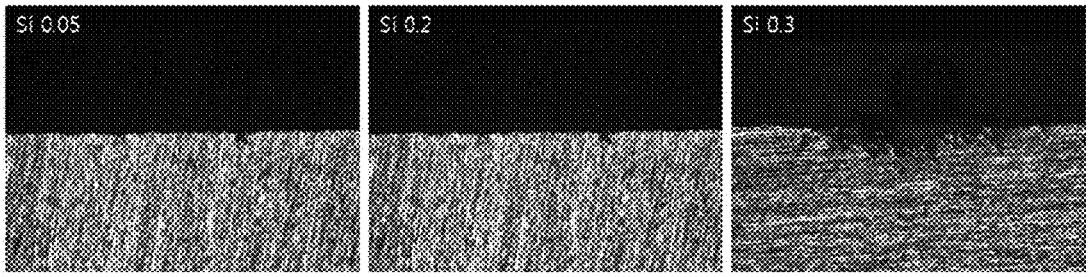
FIG. 10 illustrates pictures describing varying corrosion depths of an aluminum alloy of one embodiment of the present disclosure, relative to varying silicon contents.
Figure 11:
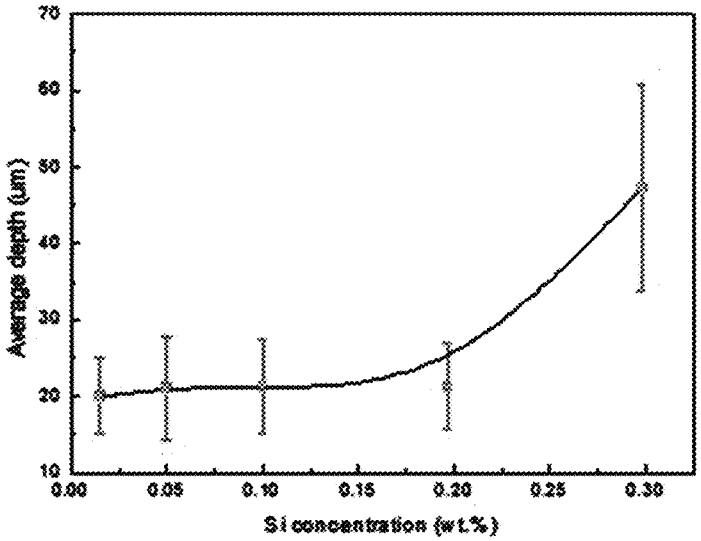
FIG. 11 illustrates a graph describing varying corrosion penetration depths of an aluminum alloy of one embodiment of the present disclosure, relative to varying silicon contents.

As seen from the above Table 4, when the silicon content is equal to or smaller than about 0.2% by weight, uniform corrosion may occur. However, when the copper content is greater than about 0.2% by weight, the uniform corrosion may not occur. Further, when the silicon content is greater than about 0.3% by weight, the corrosion penetration depth greatly increases. Specific results are illustrated in FIG. 10 and FIG. 11. As shown in FIG. 10, when the silicon content is 0.05% by weight and 0.2% by weight, corrosion penetration depths are substantially equal and low (about 20 μm). As shown in FIG. 10, when the silicon content is 0.3% by weight, the corrosion penetration depth increases greatly (about 40 μm).

Therefore, the silicon content may act as a key factor for suppressing the penetration. In accordance with the present disclosure, the silicon (Si) content may be controlled to be greater than 0% by weight and be equal to or smaller than about 0.2% by weight.

Finally, the iron (Fe) may react with the aluminum and silicon to generate precipitations acting as initiation points of cathodic reactions in corrosion environment, thereby to play a considerable role for the aluminum corrosion. Thus, the iron content should be minimized. However, the precipitations derived from the irons may reside in a non-continuous manner and, thus, be less susceptible to the interganular corrosion compared to the copper. Further, in order to reduce the content of the iron below a low concentration, a high cost may occur. Therefore, from considerations with this, in the present disclosure, the iron (Fe) content may be controlled to be greater than 0% by weight and equal to or smaller than about 0.2% by weight.

In order to examine iron contents in terms of a critical meaning, corrosion experiments under conditions of a following Table 5 were conducted. As indicated from the Table 5, contents of iron changes, while contents of remaining components, namely, zirconium, copper, and silicon are set to substantially constant level. Further, the Table 5 also indicates experimental results, that is, corrosion depth averages and corresponding corrosion depth standard deviations.

TABLE 5

| | Cu (fixed) | Si (fixed) | Fe (variable) | Zr (fixed) | corrosion depth average (μm) | corrosion depth standard deviation |
|---|---|---|---|---|---|---|
| 1 | 0.011 | 0.201 | 0.054 | 0.154 | 20.99 | 6.76 |
| 2 | 0.011 | 0.202 | 0.110 | 0.148 | 20.47 | 5.38 |
| 3 | 0.011 | 0.197 | 0.205 | 0.151 | 21.19 | 5.64 |
| 4 | 0.010 | 0.204 | 0.301 | 0.148 | 47.25 | 13.48 |

Figure 12:
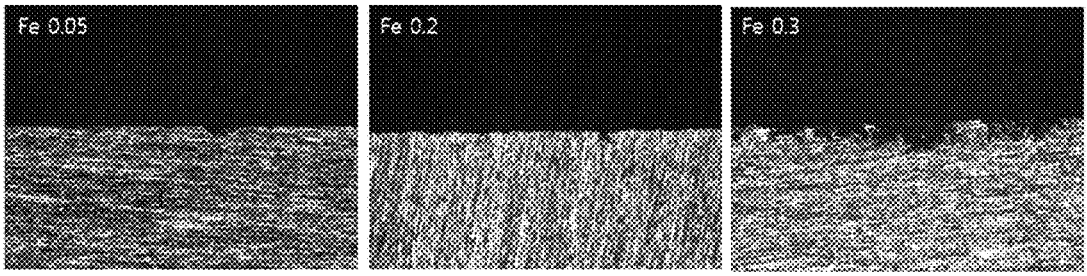
FIG. 12 illustrates pictures describing varying corrosion depths of an aluminum alloy of one embodiment of the present disclosure, relative to varying iron contents.
Figure 13:
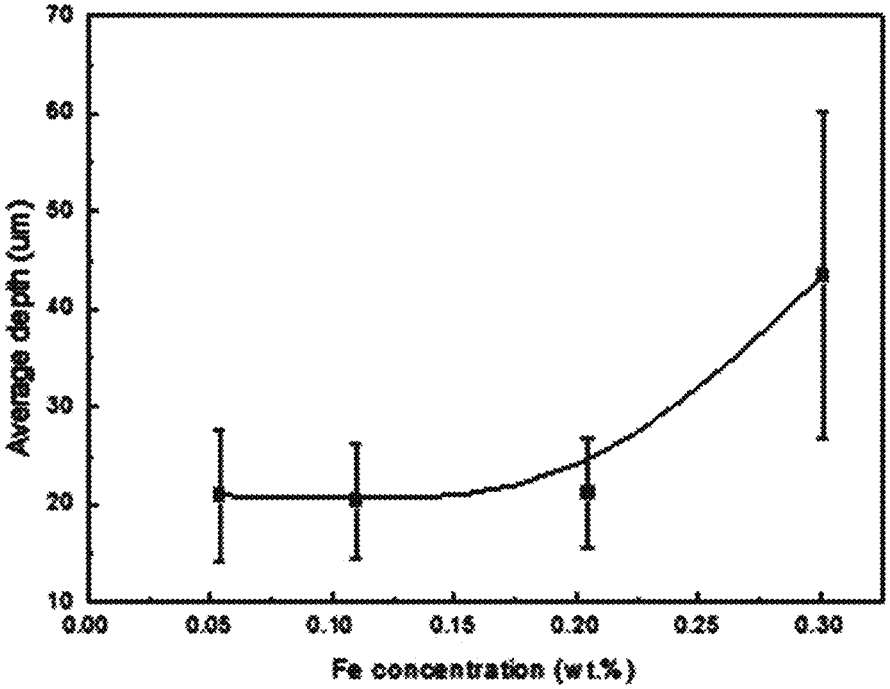
FIG. 13 illustrates a graph describing varying corrosion penetration depths of an aluminum alloy of one embodiment of the present disclosure, relative to varying iron contents.

As seen from the above Table 5, when the iron content is equal to or smaller than about 0.2% by weight, uniform corrosion may occur. However, when the iron content is greater than about 0.2% by weight, the uniform corrosion may not occur. Further, when the iron content is greater than about 0.3% by weight, the corrosion penetration depth greatly increases. Specific results are illustrated in FIG. 12 and FIG. 13. As shown in FIG. 12, when the iron content is 0.05% by weight and 0.2% by weight, corrosion penetration depths are substantially equal and low (about 20 μm). As shown in FIG. 12, when the iron content is 0.3% by weight, the corrosion penetration depth increases greatly (about 40 μm).

Therefore, the iron content may act as a key factor for suppressing the penetration. In accordance with the present disclosure, the iron (Fe) content may be controlled to be greater than 0% by weight and be equal to or smaller than about 0.2% by weight.

Although, in order to reduce the corrosion, it is preferable that both the silicon and iron contents should be minimized, both of the silicon and iron contents may be controlled to the above-defined contents due to the economical aspect. The above-defined contents thereof may suffice to provide the good aluminum alloy for a heat exchanger as illustrated below.

Figure 3A:
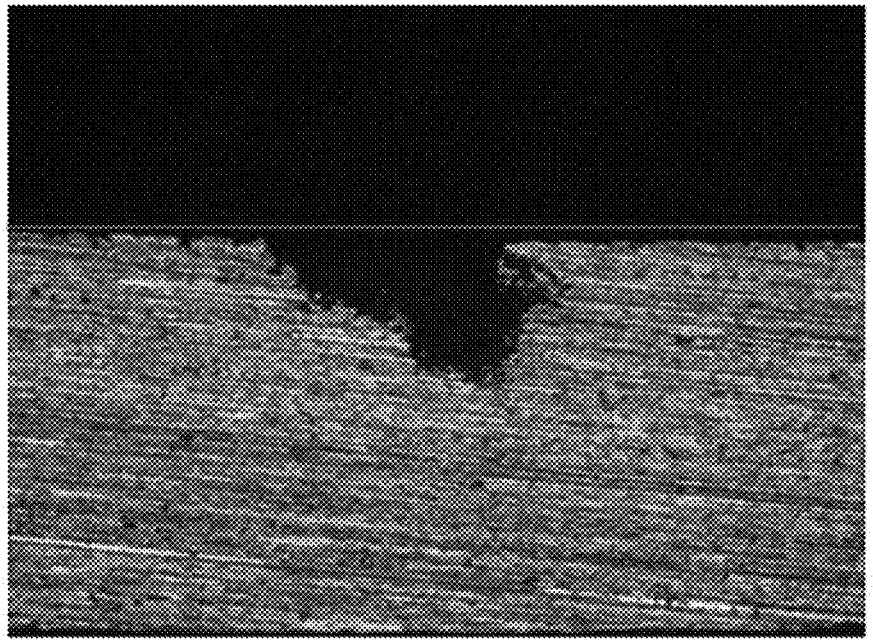
FIG. 3A and FIG. 3B illustrate cross-sectional views of a A1070 specimen as a previous 1XXX-based aluminum alloy for a heat exchanger, after being subjected to a potentiostatic polarization test.
Figure 3B:
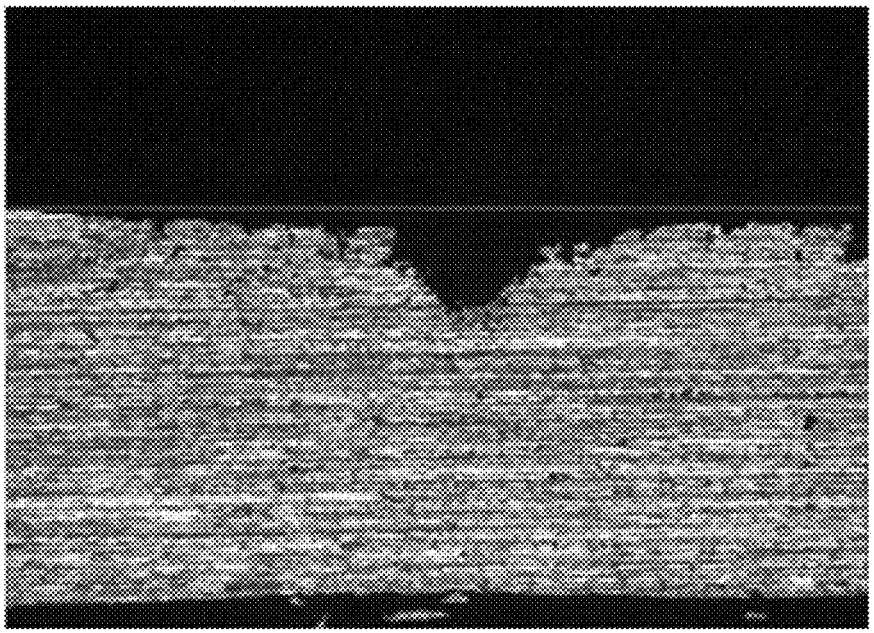
Figure 4A:
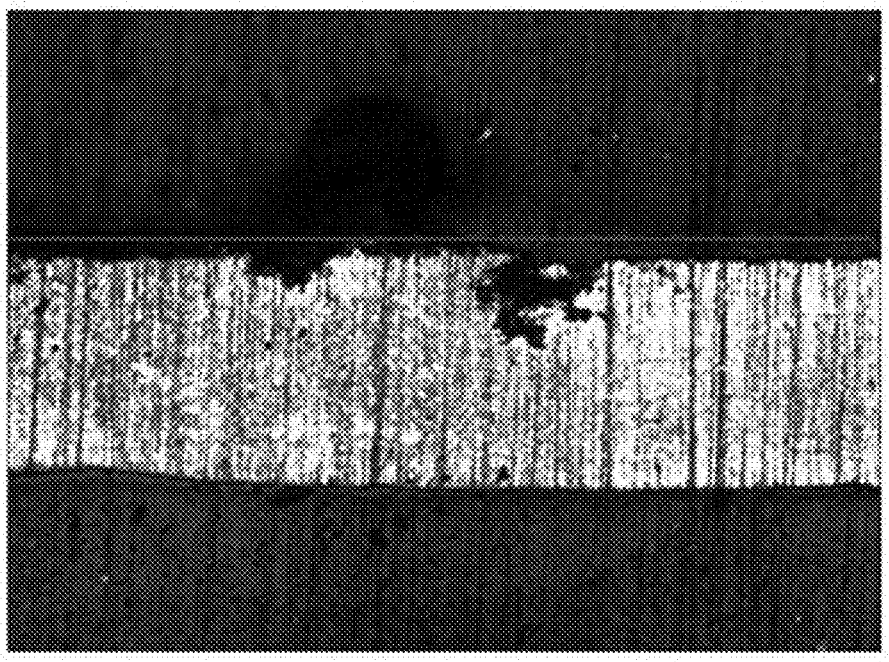
FIG. 4A and FIG. 4B illustrate cross-sectional views of a A3003 specimen as a previous 3XXX-based aluminum alloy for a heat exchanger, after being subjected to a potentiostatic polarization test.
Figure 4B:
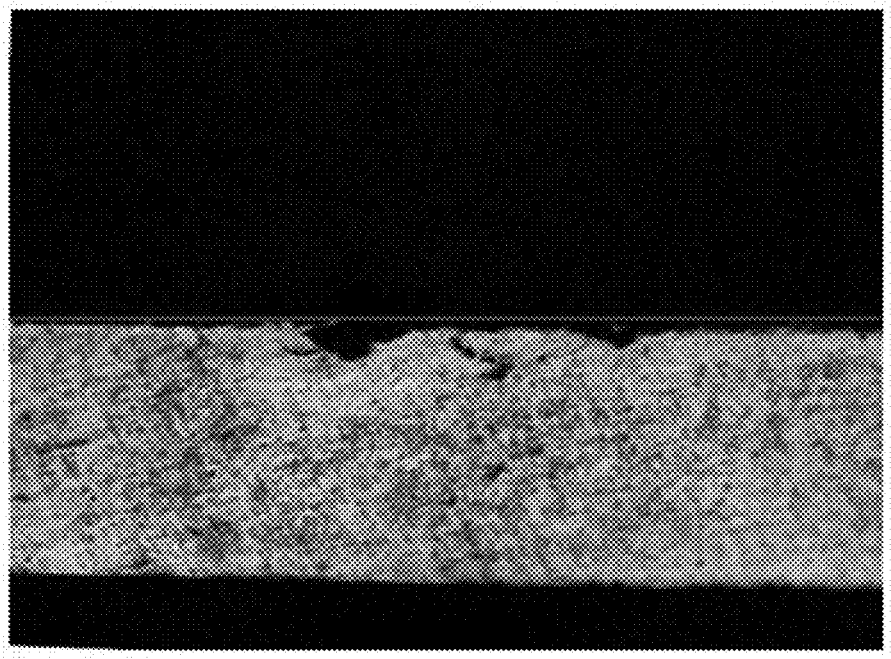
Figure 14:
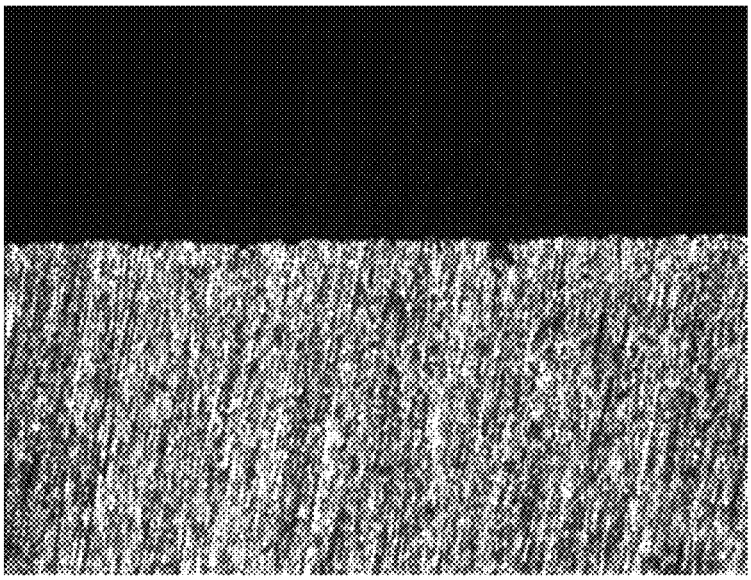
FIG. 14 illustrates a cross-sectional view of a specimen made of the aluminum alloy in accordance with one embodiment of the present disclosure, after being subjected to a potentiostatic polarization test.

FIG. 3A and FIG. 3B illustrate cross-sectional views of a A1070 specimen as a previous 1XXX-based aluminum alloy for a heat exchanger, after being subjected to a potentiostatic polarization test. FIG. 4A and FIG. 4B illustrate cross-sectional views of a A3003 specimen as a previous 3XXX-based aluminum alloy for a heat exchanger, after being subjected to a potentiostatic polarization test. FIG. 14 illustrates a cross-sectional view of a specimen made of the aluminum alloy in accordance with one embodiment of the present disclosure, after being subjected to a potentiostatic polarization test.

The specimen shown in FIG. 14 and made of the aluminum alloy in accordance with one embodiment of the present disclosure contains components Zr, Cu, Si, and Fe respectively by contents of Zr 0.15% by weight, Cu 0.01% by weight, Si 0.2% by weight, and Fe 0.2% by weight.

In the potentiostatic polarization test, a constant voltage is applied and maintained to the specimen to accelerate corrosion. This test may be useful to evaluate a corrosion resistance of the alloy. In the present disclosure, the alloy specimen is subjected to the potentiostatic polarization test for 6 hours using the synthetic acid rain simulating the external condensed water, and a cross-section of the resulting specimen is measured in terms of a corrosion depth.

Referring to FIG. 3A, FIG. 3B, FIG. 4A, FIG. 4B, and FIG. 14, a comparison between the present and previous alloys will be made in terms of the penetration depth. In this comparison, the penetration depth may be relative to the reference line (red line). In case of previous A1070 and A3003 specimens, corrosion is concentrated on a certain region, and propagate inwardly along the grain boundary, to form a large penetration depth. To the contrary, in case of the present specimen, corrosion is spread along the reference line, that is, a surface line of the alloy, and an intergranular corrosion may not occur and, thus, create a uniform corrosion, to form a small penetration depth. Hence, it is confirmed that the present specimen has a greater decrease in the corrosion propagation than in the A1070 and A3003 specimens.

TABLE 6

| | Corrosion depth (thinning) (μm) | | |
|---|---|---|---|
| | A1070 | A3003 | Present alloy |
| average | 139.14 | 96.49 | 21.19 |
| standard deviation | 98.63 | 50.07 | 5.64 |

The above Table 6 indicates corrosion depth measurements of the previous A1070 and A3003 specimens, and the present specimens made of the aluminum alloy of one embodiment of the present disclosure, after being subjected to the potentiostatic polarization test. In the Table 6, the aluminum alloy of the present disclosure contains elements Zr, Cu, Si, and Fe respectively by contents of Zr 0.15% by weight, Cu 0.01% by weight, Si 0.2% by weight, and Fe 0.2% by weight.

Referring to the Table 6, the A1070 specimens exhibit an average corrosion depth of 139.14 μm. The A3003 specimens exhibit an average corrosion depth of 96.49 μm. To the contrary, the present specimens made of the aluminum alloy of one embodiment of the present disclosure exhibit an average corrosion depth of 21.19 μm. In other words, the present specimens made of the aluminum alloy of one embodiment of the present disclosure exhibit about 5 times corrosion resistance improvement compared to the A1070 specimens. Further, the present specimens made of the aluminum alloy of one embodiment of the present disclosure exhibit an overall lowered corrosion depth deviation which means that a uniform corrosion occurs, leading to enhanced penetration resistance.

Furthermore, the present specimens made of the aluminum alloy of one embodiment of the present disclosure exhibit a good extrusion rate of about 90 m/min. This rate may be substantially equal to an extrusion rate of the previous A1070, and may be higher than an extrusion rate of the previous A3003 which is about 60-70 m/min. That is, the present specimens made of the aluminum alloy of one embodiment of the present disclosure may have a superior extrusion rate compared to the previous A3003.

The aluminum alloy of one embodiment of the present disclosure may be employed for not only an extruded tube but also for a fin in a heat exchanger. The heat exchanger comprising those extruded tube and fin may be classified into a stack type, a tube type, draw-on cap type, etc. in terms of a structure.

In particular, the tube type heat exchanger may increase heat dissipation via a fin internally attached thereto or a pipe having multiple holes formed therein. Specifically, the heat exchanger may be manufactured by provisionally assembling the extruded tube with a fin, a plate and a side tank, etc. and fixing one another via a clamp, and applying a flux treatment to the fixed structure, and passing the structure through a brazing furnace.

In this way, the aluminum alloy of the present disclosure for the heat exchanger has greatly enhanced corrosion resistance, and, thus, the heat exchanger made of the alloy has enhanced penetration resistance, leading to a prolonged life span and improved performance.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. An aluminum alloy with enhanced corrosion resistance for a heat exchanger, the alloy consisting essentially of in % by weight:

$0.052\% \leq Zr \leq 0.169\%$;

$0\% < Cu \leq 0.01\%$;

$0\% < Si \leq 0.2\%$;

$0\% < Fe \leq 0.2\%$; and the remainder being Al, and unavoidable impurities.

2. An aluminum tube with enhanced corrosion resistance for a heat exchanger, the tube being made of the aluminum alloy of claim 1.

3. An aluminum fin with enhanced corrosion resistance for a heat exchanger, the fin being made of the aluminum alloy of claim 1.

4. A heat exchanger with enhanced corrosion resistance, the exchanger comprising the aluminum tube of claim 2.

5. A heat exchanger with enhanced corrosion resistance, the exchanger comprising the aluminum fin of claim 3.

6. A heat exchanger with enhanced corrosion resistance, the exchanger comprising an aluminum fin and an aluminum tube, wherein both the fin and tube are made of the alloy of claim 1.

7. The aluminum alloy of claim 1, wherein the alloy has an average corrosion depth equal to or smaller than 28 μm when being subjected to a test in which the alloy, with an exposure area of 1 $cm^2$thereof, is immersed for 4 hours in a test solution of pH 5 containing 4 ppm $SO4^{2-}$, 2.5 ppm $NO^{2-}$, and 1.7 ppm $Cl^-$, and, then, has a constant potential of 0.25 V applied thereto for 6 hours, the potential being relative to SCE (saturated calomel electrode).

8. The aluminum alloy of claim 1, wherein a content of the Zr is 0.151% by weight.

* * * * *